US005846405A

United States Patent [19]

Aldous et al.

[11] Patent Number: 5,846,405

[45] Date of Patent: Dec. 8, 1998

[54] PROCESS OILS AND MANUFACTURING PROCESS FOR SUCH USING AROMATIC ENRICHMENT AND TWO PASS HYDROFINISHING

[75] Inventors: Keith Kaluna Aldous, League City; Jacob Ben Angelo, Spring, both of Tex.; Joseph Philip Boyle, Baton Rouge, La.; Bruce M. Jarnot, Martinsville, N.J.; Wayne E Hanson, Baytown, Tex.

[73] Assignee: Exxon Research and Engineering Company, Florham Park, N.J.

[21] Appl. No.: 897,099

[22] Filed: Jul. 18, 1997

[51] Int. Cl.[6] ..... C10G 23/00

[52] U.S. Cl. ..... 208/211; 208/303; 208/264; 208/301; 208/311; 208/87; 208/302; 208/45; 208/89; 208/210

[58] Field of Search ..... 585/6; 208/14, 208/210, 301, 303, 311, 87, 45, 264, 89

[56] References Cited

U.S. PATENT DOCUMENTS

| | | | |
|---|---|---|---|
| 3,732,154 | 5/1973 | Mills | 208/87 |
| 3,925,220 | 12/1975 | Mills | 208/63 |
| 4,521,296 | 6/1985 | Kunihiro et al. | 208/87 |

*Primary Examiner*—Helane Myers
*Attorney, Agent, or Firm*—Roy J. Ott

[57] ABSTRACT

A method for producing a process oil is provided in which an aromatic extract oil is added to a napthenic rich feed. The combined feed is then hydrotreated in a first hydrotreating stage to convert at least a portion of sulfur and nitrogen in the feed to hydrogen sulfide and ammonia. After stripping the feed is subjected to a second hydrotreating stage to provide a process oil.

7 Claims, No Drawings

PROCESS OILS AND MANUFACTURING PROCESS FOR SUCH USING AROMATIC ENRICHMENT AND TWO PASS HYDROFINISHING

FIELD OF THE INVENTION

The present invention is concerned generally with the production of process oils from naphthenic containing distillates.

BACKGROUND OF THE INVENTION

The properties of naphthenic rich feeds render them useful in the manufacture of process oils. As is well known in the art, process oils are used in a wide variety of industrial applications. For example, they are used in processing natural and synthetic rubbers for a number of reasons such as reducing the mixing temperature during processing of the rubber and preventing scorching or burning of the rubber polymer when it is being ground down to a powder, or modifying the physical properties of the finished rubber and the like.

End-users of such process oils desire oils with increased solvency as indicated by a lower aniline point. Accordingly, one object of the present invention is to provide a process oil that has a lower aniline point and consequently increased solvency.

Additionally, the availability of conventional naphthenic crudes is declining while the demand for higher solvency process oils is increasing. Accordingly, it is another object of the present invention to provide process oils with increased solvency using lesser amounts of naphthenic rich feeds such as naphthenic distillates.

SUMMARY OF THE INVENTION

A method for producing a process oil is provided which comprises adding an aromatic containing extract oil to a naphthenic rich feed to provide a feed for processing; hydrotreating the feed in a first hydrotreating stage maintained at a temperature of about 300° C. to about 375° C. and a hydrogen partial pressure of about 300 to about 2500 psia to convert at least a portion of the sulfur in the feed to hydrogen sulfide and nitrogen in the feed to ammonia; stripping the hydrotreated feed from the first hydrotreating stage to remove hydrogen sulfide and ammonia; thereafter hydrotreating the hydrotreated feed in a second hydrotreating stage maintained at a temperature lower than the first stage in the range of about 275° C. to about 370° C. and a hydrogen pressure of about 300 to about 2500 psia to form a process oil.

These and other embodiments of the invention will become apparent from the reading of the detailed description of the invention which follows.

DETAILED DESCRIPTION OF THE INVENTION

Typically the naphthenic rich feed used to produce process oils in accordance with the method of the present invention will comprise a naphthenic distillate although other naphthenic rich materials obtained by extraction or solvent dewaxing may be utilized.

In accordance with the present invention, an aromatic extract oil is added to the naphthenic rich distillate to provide a feed for hydrotreating. Preferably the aromatic extract oil used in the present invention will have an aniline point less than about 75° C. for high viscosity oils (e.g., greater than about 1000 SSU @ 100° F.) and less than about 40° C. for low viscosity oils (e.g., about 70 SSU to about 1000 SSU @ 100° F.).

Such an aromatic oil suitable in the process of the present invention is readily obtained by extracting a naphthenic distillate with aromatic extraction solvents in extraction units known in the art. Typical aromatic extraction solvents include N-methylpyrrolidone, phenol, N,N dimethyl formamide, dimethylsulfoxide, methyl carbonate, morpholine, furfural and the like, preferably N-methylpyrrolidone or phenol. Solvent to oil to treat ratios are generally from about 1:1 to about 3:1. The extraction solvent preferably contains water in the range from about 1 vol.% to about 20 vol. %. Basically the extraction can be conducted in a counter-current type extraction unit. The resultant aromatic rich solvent extract stream is then solvent stripped to provide an aromatic extract oil having an aromatic content in the range 50% to 90% by weight.

The aromatic extract oil is mixed with the same or different viscosity naphthenic distillate from which it is extracted in the extract to a distillate volume ratio in the range of about 10:90 to 90:10, preferably 25:75 to 50:50. Typical, but not limiting examples of distillates, extract oils and distillate/extract mixtures are provided in Tables 1 and 2 for low viscosity and high viscosity oils respectively.

TABLE 1

LOW VISCOSITY DISTILLATE, EXTRACT OIL, AND BLENDS

| | Distillate Feed | Extract Oil | Extract/ Distillate (25:75) | Extract/ Distillate (50:50) |
|---|---|---|---|---|
| Physical Properties | | | | |
| API Gravity, 60/60° F. | 24.5 | 15.8 | 21.8 | 19.8 |
| Specific Gravity, 60/60° F. | 0.9068 | 0.9606 | 0.9228 | 0.9352 |
| Viscosity Index | 18.5 | −67.9 | −0.1 | −13.7 |
| Viscosity @ 100° F., SSU | 88.9 | 129.2 | 97.5 | 103.3 |
| Refractive Index @ 20° C. | 1.5009 | 1.5364 | 1.5114 | 1.5191 |
| Aniline Point, °F. (°C.) | 156(69) | 76.3(24) | 129(54) | 123(51) |
| Pour Point, °F. | −49 | — | −54 | −54 |
| Flash, °F. | 360 | — | 366 | 356 |
| Sulfur, wt. % | 0.91 | 1.8 | 1.15 | 1.38 |
| Basic Nitrogen, PPM | 123 | 306 | 178 | 217 |
| Total Nitrogen, PPM | 706 | 1529 | 1046 | 1176 |
| Neut Number, KOH/g | 0.78 | 1.91 | 1.09 | 1.34 |
| Compositional Properties | | | | |
| Clay Gel Saturates, wt. % | 58.3 | 27.2 | 45.1 | 38.5 |
| Clay Gel Aromatics, wt. % | 40.2 | 69.1 | 52.0 | 57.8 |
| Clay Gel Polars, wt. % | 1.6 | 3.7 | 2.9 | 3.7 |
| UV DMSO, 280–289 NM, Absorbance/cm | 1196 | — | 1390 | 1620 |
| UV DMSO, 290–299 Absorbance/cm | 1060 | — | 1220 | 1410 |
| UV DMSO, 300–359 nm, Absorbance/cm | 823 | — | 930 | 1040 |
| UV DMSO, 360–400 NM, Absorbance/cm | 43 | — | 40 | 50 |

TABLE 2

HIGH VISCOSITY DISTILLATE, EXTRACT OIL, AND BLENDS

| | Distillate Feed | Extract Oil | Extract/ Distillate (25:75) | Extract/ Distillate (50:50) |
|---|---|---|---|---|
| Physical Properties | | | | |
| API Gravity, 60/60° F. | 19.8 | 17.4 | 18.9 | 18.5 |
| Specific Gravity, 60/60° F. | 0.9350 | 0.9504 | 0.9406 | 0.9436 |
| Viscosity Index | 34.8 | −34.6 | 20 | 6.6 |
| Viscosity, SSU @ 100° F. | 2873 | 1382 | 2375 | 1969 |
| Refractive Index @ 20° C. | 1.5191 | 1.5285 | 1.5210 | 1.5228 |
| Aniline Point, °F. (°C.) | 197(92) | 154(68) | 174(79) | 176(80) |
| Pour Point, °F. | 21 | — | — | — |
| Flash, °F. | 540 | — | 503 | 474 |
| Sulfur, wt. % | 1.21 | 0.43 | 0.98 | 0.83 |
| Basic Nitrogen, PPM | 486 | 368 | 460 | 453 |
| Total Nitrogen, PPM | 2474 | 2352 | 4347 | 2897 |
| Neut Number, KOH/g | 0.93 | 0.02 | 0.57 | 0.37 |
| Compositional Properties | | | | |
| Clay Gel Saturates, wt. % | 47.9 | 39.8 | 45.6 | 43.2 |
| Clay Gel Aromatics, wt. % | 44.6 | 56.9 | 47.5 | 50.9 |
| Clay Gel Polars, wt % | 7.5 | 3.3 | 6.9 | 5.9 |
| UV DMSO, 280–289 nm, Absorbance/cm | 2613 | | 3930 | 2500 |
| UV DMSO, 290–299 nm, Absorbance/cm | 2356 | | 3480 | 2170 |
| UV DMSO, 300–359 nm, Absorbance/cm | 1960 | | 2920 | 1740 |
| UV DMSO, 360–400 nm, Absorbance/cm | 333 | | 710 | 280 |

The resultant mixture is then subjected to hydrotreating in a first hydrotreating stage. The first hydrotreating stage preferably is maintained within the range of about 300° C. to 375° C. and more preferably within the range of about 340° to 365° C. at a hydrogen partial pressure in the range from about 300 to about 2500 psia and preferably from about 500 to about 1200 psia. Hydrotreating is conducted in the first stage at a liquid hourly space velocity in the range 0.1–2 v/v/hour sufficient to convert at least a portion of the sulfur present in the feed to hydrogen sulfide and nitrogen in the feed to ammonia.

The hydrotreated feed from the first hydrotreating stage then is passed into an intermediate stripping stage, for example, to remove the hydrogen sulfide and ammonia.

Next the hydrotreated feed from the intermediate stripping stage is treated in a second hydrotreating stage which is maintained at a temperature in the range of about 275° C. to 370° C. and preferably in the range of about 300° C. to 330° C. at a hydrogen partial pressure of about 300 to 2500 psia and preferably in the range of about 500 to 1200 psia for a time sufficient to produce a process oil for example having an aniline point below about 65° C. for a low viscosity oil and below about 100° C. for a high viscosity oil.

The hydrotreating is effected conventionally under hydrogen pressure and with a conventional catalyst. Catalytic metals such as nickel, cobalt, tungsten, iron, molybdenum, manganese, platinum, palladium, and combinations of these supported on conventional supports such as alumina, silica, magnesia, and combinations of these with or without acid-acting substances such as halogens and phosphorous may be employed. A particularly preferred catalyst is a nickel molybdenum phosphorus catalyst supported on alumina, for example KF-840.

As is shown in the following examples and comparative examples, the present invention has been found to produce a process oil having a substantially reduced aniline point and increased solvency. Moreover the data shows that product of the second stage of the process of the present invention requires less distillate than is required to produce an equivalent amount of product if the procedure of the comparative example is followed.

Comparative Example 1 (First Base Case)

In this comparative example a naphthenic feedstock having a viscosity of 89 SSU at 100° F. was passed through two hydrotreating stages under the conditions outlined in Table 3 below. Feed properties are provided in Table 1.

TABLE 3

| | STAGE 1 | STAGE 2 |
|---|---|---|
| Temperature, °C. | 354 | 315 |
| $H_2$ Partial Pressure, psia | 550 | 652 |
| Gas (100% $H_2$)Treat, SCF/Barrel | 450 | 450 |
| Space Velocity, V/V/HR | 0.7 | 0.7 |

The product from stage 1 was stripped in an intermediate step so as to remove hydrogen sulfide and ammonia. The product of this Comparative Example had the properties shown in Table 5.

EXAMPLE 1

In this example, a quantity of the same naphthenic feedstock utilized in Comparative Example 1 was extracted using 6% water and phenol in a countercurrent extraction column at a treat ratio of 120 liquid volume percent and at a temperature of 58° C. After removal of the solvent, an aromatic extract oil having the properties shown in Table 1 was obtained. To another quantity of the same naphthenic feed was added an equal volume of the aromatic extract oil. Table 1 provides properties of the naphthenic distillate, aromatic extract and two blends for the lower viscosity oil. The 50% blend was hydrotreated in two stages under the conditions set forth in Table 4 below.

TABLE 4

| | STAGE 1 | STAGE 2 |
|---|---|---|
| Temperature, °C. | 354 | 315 |
| $H_2$ Partial Pressure, psig | 652 | 652 |
| Gas (100% $H_2$)Treat, SCF/Barrel | 450 | 450 |
| Space Velocity, V/V/HR | 0.7 | 0.7 |

As with Comparative Example 1, after stage 1 the material was stripped so as to remove hydrogen sulfide and ammonia. By using this procedure, 50% less distillate was required to produce an amount of product equivalent to that in Comparative Example 1. The quality of the product of this Example 1 is given in Table 5 which follows.

TABLE 5

| | Comparative Ex. 1 | 50% Extract Example 1 |
|---|---|---|
| Aniline Point, °F. | 171 | 151 |
| Sulfer, wt. % | <0.05 | <0.05 |
| Viscosity, 100° F., SSU | 84.2 | 86.0 |
| Color ASTM | <1.0 | 1.0 |
| HPLC-2, wt. % | | |
| Saturates | 61.3 | 59.2 |
| 1-ring aromatics | 29.5 | 34.3 |
| 2-ring aromatics | 5.3 | 6.5 |
| 3-ring + aromatics | 2.6 | 0 |
| PNA's 4–6 ring, ppm | 18.3 | 23.2 |
| Mutagenicity Index | 0 (Pass) | 0 (Pass) |
| IP346, wt. % | 4 | 5 |
| UV-DMSO Absorbance, $cm^{-1}$ | | |
| 280–289 nm | 386 | 521 |
| 290–299 nm | 291 | 402 |
| 300–359 nm | 218 | 295 |
| 360–400 nm | 10 | 15 |

As can be seen, this product has an improved solvency with a 20° F. lower aniline point.

Comparative Example 2 (Second Base Case)

In this Comparative Example 2, a naphthenic feedstock having a viscosity of 2873 SSU @ 100° F. having the properties shown in Table 2 was passed through two hydrotreating stages under the conditions outlined in Table 6 below. Table 2 provides the properties of the naphthenic distillate, aromatic extract and two blends for the higher viscosity oil.

TABLE 6

| | STAGE 1 | STAGE 2 |
|---|---|---|
| Temperature, °C. | 355 | 315 |
| $H_2$ Partial Pressure, psia | 532 | 656 |
| Gas (80% $H_2$) Treat, SCF/Barrel | 625 | 625 |
| Space Velocity, V/V/HR | 0.75 | 0.75 |

In this Comparative Example 2 after hydrotreating under the conditions of Stage 1 the material is stripped to remove hydrogen sulfide and ammonia. The product of the second stage represents a process oil having the properties shown in Table 8 below.

EXAMPLE 2

A quantity of an intermediate distillate of with a viscosity of 1000 SSU @ 100° F. was extracted following the general procedures outlined in Example 1 above to provide an aromatic extract oil. This aromatic extract oil was blended in a 50/50 volume ratio with another quantity of the same heavy distillate used in the Comparative Example 2 above. The blend, the properties of which are shown in Table 2, was hydrotreated in 2 stages under the conditions set forth in Table 7 below. Following the Stage 2 treatment the sample was of course stripped to remove hydrogen sulfide or ammonia. The product of the second stage had the properties shown in Table 8 below.

TABLE 7

| | Stage 1 | Stage 2 |
|---|---|---|
| Temperature, °C. | 355 | 315 |
| $H_2$ Partial Pressure, psia | 656 | 656 |
| Gas (80% $H_2$) Treat, SCF/Barrel | 625 | 625 |
| Space Velocity, V/V/HR | 0.75 | 0.75 |

This example illustrates that when a heavy distillate is enriched with an aromatic extract oil and subjected to a two-pass hydrofinishing, the resulting product has a higher yield on fresh distillate and improved solvency with an aniline point 21° F. lower.

EXAMPLE 3

A quantity of the same intermediate distillate of Comparative Example 2 was extracted following the general procedures outlined in Example 1 above to provide an aromatic extract oil. This aromatic extract oil was blended in a 25/75 volume ratio with another quantity of the same heavy distillate used in the Comparative Example 2 above. The blend, the properties of which are shown in Table 2, was hydrotreated in 2 stages under the conditions set forth in Table 7 below. Following the Stage 2 treatment the sample was of course stripped to remove hydrogen sulfide or ammonia. The product of the second stage had the properties shown in Table 8 below.

TABLE 8

| | Comparative Ex. 1 | 50% Extract Example 2 | 25% Extract Example 3 |
|---|---|---|---|
| Aniline Point, °F. | 207 | 186 | 196 |
| Sulfer, wt. % | 0.19 | 0.15 | 0.18 |
| Viscosity, 100° F., SSU | 1171 | 1127 | 1269 |
| Color ASTM | <2.5 | <2.0 | <2.5 |
| PNA's 4–6 ring, ppm | 13.5 (typical) | 5.2 | 14.5 |
| Mutagenicity Index | N/A | 0.8, 1.7 (Pass) | 0, <1 (Pass) |
| IP346, wt. % | N/A | 3.6 | 3.4 |
| UV-DMSO Absorbance, cm−1 | | | |
| 280–289 nm | 821 | 583 | 762 |
| 290–299 nm | 783 | 567 | 718 |
| 300–359 nm | 678 | 477 | 600 |
| 360–400 nm | 86 | 37 | 72 |

This example illustrates that when a heavy distillate is enriched with an aromatic extract oil and subjected to a two-pass hydrofinishing, the resulting product has a higher yield on fresh distillate and improved solvency with an aniline point 11° F. lower.

What is claimed is:

1. A method for producing a process oil comprising:

adding an aromatic extract oil to a naphthenic rich to provide a feed for hydrotreating;

hydrotreating the provided feed in a first hydrotreating stage at a temperature in the range of about 300° C. to about 375° C., a partial hydrogen pressure of 300 to 2500 psia and a liquid hourly space velocity of 0.1 to 2.0 v/v/hr to provide a hydrotreated feed;

removing hydrogen sulfide and ammonia from the hydrotreated feed;

thereafter hydrotreating the hydrotreated feed in a second hydrotreating stage at a lower temperature than the first stage and in the range of about 275° C. to about 370° C., a hydrogen partial pressure of 300 to 2500 psig and a space velocity of 0.1 to 2.0 v/v/hr.

2. The method of claim 1 wherein the naphthenic rich feed is a naphthenic distillate.

3. The method of claim 2 wherein the aromatic extract oil is added to the naphthenic distillate in the volume ratio of about 10:90 to about 90:10.

4. The method of claim 3 wherein the volume ratio is in the range of about 25:75 to about 50:50.

5. The method of claim 4 wherein the temperature in the first stage is in the range of 340° C. to 365° C. and in the second stage in the range of 300° C. to 330° C.

6. The method of claim 5 wherein the aromatic extract oil has an aromatic content of about 50% to about 90% by weight.

7. A method for producing a process oil comprising:

solvent extracting a napthenic distillate to obtain an aromatic rich solvent stream;

removing the solvent from the stream to obtain an aromatic rich extract oil;

adding the aromatic rich extract oil to a naphthenic distillate in the volume ratio of from about 25:75 to about 50:50 to obtain a feed;

hydrotreating the feed in a first hydrotreating stage at a temperature in the range of about 300° C. to about 375° C., a partial hydrogen pressure of 300 to 2500 psia and a liquid hourly space velocity of 1.0 to 2.0 v/v/hr;

removing hydrogen sulfide and ammonia from the hydrotreated feed;

thereafter hydrotreating the feed in a second hydrotreating stage at a lower temperature than the first stage and in the range of about 275° C. to to about 370° C., a hydrogen partial pressure of 300 to 2500 psig and a space velocity of 0.1 to 2.0 v/v/hr.

* * * * *